US008509638B2

(12) United States Patent
Zollner

(10) Patent No.: US 8,509,638 B2
(45) Date of Patent: Aug. 13, 2013

(54) ARRANGEMENT TO REGULATE THE PROPORTIONS OF TWO COMPONENTS TO BE MIXED IN A MIXING UNIT BASED ON PREDETERMINED DESIRED VALUES

(75) Inventor: Alfred Zollner, Eitting (DE)

(73) Assignee: OcéPrinting Systems GmbH, Poing (DE)

( * ) Notice: Subject to any disclaimer, the term of this patent is extended or adjusted under 35 U.S.C. 154(b) by 280 days.

(21) Appl. No.: 13/101,246

(22) Filed: May 5, 2011

(65) Prior Publication Data

US 2011/0286757 A1 Nov. 24, 2011

(30) Foreign Application Priority Data

May 18, 2010 (DE) ..... 10 2010 017 005

(51) Int. Cl.
*G03G 15/10* (2006.01)

(52) U.S. Cl.
USPC ..... 399/57; 399/237

(58) Field of Classification Search
USPC ..... 399/57, 58, 237, 238
See application file for complete search history.

(56) References Cited

U.S. PATENT DOCUMENTS 3,608,869 A 9/1971 Woodle
5,003,352 A 3/1991 Duchesne et al.
7,764,891 B2 * 7/2010 Du et al. ..... 399/62
8,285,165 B2 * 10/2012 Hirai ..... 399/57
2006/0150836 A1 7/2006 Berg et al.

FOREIGN PATENT DOCUMENTS

JP 04045468 A 2/1992
JP 2004117687 A 4/2004
WO 2005/013013 A2 2/2005

* cited by examiner

*Primary Examiner* — Hoang Ngo
(74) *Attorney, Agent, or Firm* — Schiff Hardin LLP

(57) ABSTRACT

In a method or system for regulation of real values of toner concentration and fill level in a mixing unit to predetermined desired values in a developer station of an electrographic printing apparatus, the real value of the toner concentration in the mixing unit is adjusted with a first control unit by supplying toner concentrate from a first reservoir. A desired toner concentrate value is determined from the predetermined desired values of the toner concentration and the fill level. A real concentrate value is also determined from the real values of the toner concentration and the fill level measured in the mixing unit. With the first control unit, a feed of toner concentrate into the mixing container is regulated depending on a difference between the real toner concentrate value and the desired toner concentrate value. The real value of the fill level in the mixing unit is also adjusted with a second control unit by supplying carrier fluid from a second reservoir. A desired carrier fluid value is determined from the predetermined desired values of the toner concentration and the fill level. A real carrier fluid value is also determined from the real values of the toner concentration and the fill level measured in the mixing unit. With the second control unit, a feed of carrier fluid into the mixing unit is regulated depending on a difference between the real carrier fluid value and the desired carrier fluid value.

10 Claims, 7 Drawing Sheets

ARRANGEMENT TO REGULATE THE PROPORTIONS OF TWO COMPONENTS TO BE MIXED IN A MIXING UNIT BASED ON PREDETERMINED DESIRED VALUES

BACKGROUND

Such a control arrangement can in particular be used advantageously to regulate the toner concentration and the fill level in a mixing unit (having at least toner and carrier fluid) in the developer station of an electrographic printing apparatus. Assuming this use case the control arrangement of this application is therefore described without the control arrangement being limited to this use case.

For single color or multicolor printing of a printing substrate (for example of a single page or of a belt-shaped recording material made of the most varied materials, for example paper or thin plastic or metal films), it is known to generate image-dependent charge images on a charge image carrier (for example a photoconductor), the image-dependent charge images corresponding to the images to be printed, and comprised of regions to be inked and regions that are not to be inked. With a developer station the regions of the charge images that are to be inked are revealed on the charge image carrier via toner as toner images. The toner image that is thereby generated is subsequently transfer-printed onto a printing substrate and fixed there in a transfer printing zone.

A developer fluid having at least charged toner and carrier fluid can thereby be used to ink the charge images. Possible carrier fluids are hydrocarbons, silicone oils and others.

A method for such an electrophoretic printing in digital printing systems is known from WO 2005/013013 A2 (US 2006/0150836 A1, DE 10 2005 055 156 B3), for example. After the charge images of the images to be printed have been generated on the charge image carrier, these are inked with toner into toner images by a developer station. Here carrier fluid containing silicone oil, with dye particles (toner) dispersed in it, is thereby used as a developer fluid. The feed of the developer fluid to the charge image carrier can take place via a developer roller to which the developer fluid is supplied by a raster roller on which a chamber blade is arranged. The toner images are subsequently accepted from the charge image carrier by a transfer unit and transferred onto the printing substrate in a transfer printing zone.

In the developer station (for example in a mixing unit) the developer fluid used in the printing apparatus can be mixed together from a toner concentrate having toner and carrier fluid and from carrier fluid. The toner concentrate and the carrier fluid can respectively be contained in reservoirs and can be regulated in the printing operation, for example they can be transported into the mixing unit by means of pumping. For a proper print image it is necessary that enough toner is contained in the carrier fluid so that the toner concentration in the developer fluid has the provided value. It must thereby be taken into account that in the printing operation carrier fluid is continually taken from the mixing unit and partially applied to the printing substrate. The remaining developer fluid with lower toner concentration that was not used for the printing can be supplied to the mixing unit again or can be discarded in a waste container.

The toner concentration and the fill level in the mixing unit change due to the continuous removal and resupply of developer fluid or in particular of toner. However, both variables (toner concentration and fill level) should be kept constant at predetermined desired values via regulation. This can take place solely via the feed of the aforementioned components, namely toner concentrate (toner and carrier fluid) and carrier fluid. The problem thereby exists that the goals to be achieved—namely adjustment of the desired values for the toner concentration and for the fill level in the mixing unit—are coupled with one another and mutually influence one another. For example, the increase of the toner concentration by supplying toner concentrate also leads to an increase of the fill level. Or the decrease of the toner concentration by supplying carrier fluid leads to an increase of the fill level.

An additional problem is to be considered: for the print quality the toner concentration in the mixing unit is decisive (the fill level is of subordinate importance for this); accordingly it should be possible to preferentially adjust the toner concentration in the mixing unit.

An electrographic printing apparatus that has a mixing unit and reservoir for toner concentrate, carrier fluid and charge control substances in the developer station is known from U.S. Pat. No. 5,003,352. The fluids are transported into the mixing unit with the aid of pumps. The fill level is adjusted with a 2-point regulation. Limit value switches for different fill levels serve as sensors. The toner concentration is determined via optical transparency measurement and is readjusted by a separate 2-point regulator. The conductivity in the mixing unit is measured with the aid of electrodes and is regulated with a separate 2-point regulator. All three regulations operate independent of one another. There is no preference given to any control goal.

One method to mix multiple fluids is known from U.S. Pat. No. 3,608,869. The fluid level is regulated via 2-point regulators. The proportions of the individual fluid components to be mixed result from the activation durations of the respective feed pumps. There is no sensor that measures the mixture ratio; and a regulation of the mixture ratio is not provided.

SUMMARY

It is an object to specify an arrangement to regulate the proportions of two components to be mixed based on predetermined desired values, via which the problems illustrated above cannot substantially occur. In particular, in the operation of an electrographic printing apparatus the control arrangement should be suitable to be able to regulate the toner concentration and the fill level in a mixing unit substantially without the disadvantages specified above. In addition to this, it should be possible to prioritize the regulation of the toner concentration or of the fill level in the mixing unit.

In a method or system for regulation of real values of toner concentration and fill level in a mixing unit to predetermined desired values in a developer station of an electrographic printing apparatus, the real value of the toner concentration in the mixing unit is adjusted with a first control unit by supplying toner concentrate from a first reservoir. A desired toner concentrate value is determined from the predetermined desired values of the toner concentration and the fill level. A real concentrate value is also determined from the real values of the toner concentration and the fill level measured in the mixing unit. With the first control unit, a feed of toner concentrate into the mixing container is regulated depending on a difference between the real toner concentrate value and the desired toner concentrate value. The real value of the fill level in the mixing unit is also adjusted with a second control unit by supplying carrier fluid from a second reservoir. A desired carrier fluid value is determined from the predetermined desired values of the toner concentration and the fill level. A real carrier fluid value is also determined from the real values of the toner concentration and the fill level measured in the mixing unit. With the second control unit, a feed of carrier fluid into the mixing unit is regulated depending on a difference between the real carrier fluid value and the desired carrier fluid value.

DESCRIPTION OF THE PREFERRED EMBODIMENT

Figure 1:
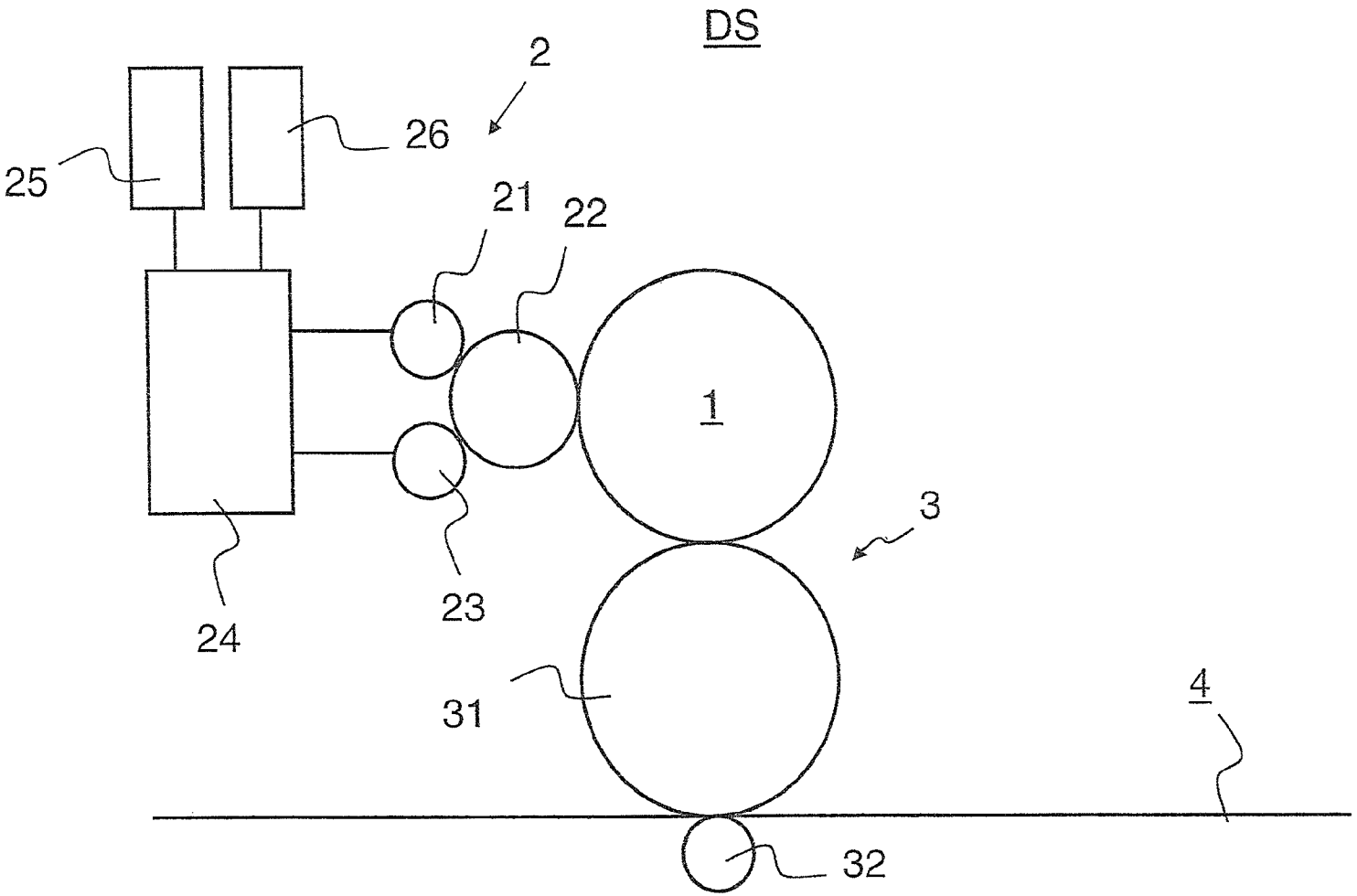
FIG. 1 is a principle representation of an electrophoretic printing apparatus.

For the purposes of promoting an understanding of the principles of the invention, reference will now be made to a preferred embodiment/best mode illustrated in the drawings and specific language will be used to describe the same. It will nevertheless be understood that no limitation of the scope of the invention is thereby intended, and such alterations and further modifications in the illustrated embodiment and such further applications of the principles of the invention as illustrated as would normally occur to one skilled in the art to which the invention relates are included.

In the use case of an electrographic printing apparatus, the control arrangement according to the preferred embodiment has a reservoir for a toner concentrate having at least toner and carrier fluid, the toner concentrate being connected via a first control element with a mixing unit for the developer fluid. A first control unit is provided with a first controller that regulates the first control element such that the predetermined desired value of the toner concentration in the mixing unit is adjusted by supplying toner concentrate from the reservoir for toner concentrate. The first controller thereby regulates the first control element depending on the real value and the desired value of the toner concentration and the fill level (toner concentration regulation). Furthermore, a second control unit corresponding to the first control unit can be provided for the regulation of the fill level in the mixing unit. This is then executed such that it provides a second regulator that regulates a second control element such that this transports carrier fluid from a reservoir with carrier fluid into the mixing unit until the predetermined desired value of the fill level in the mixing unit is reached. The second controller thereby likewise regulates the second control element depending on the real value and the desired value of the toner concentration and the fill level (fill level regulation).

Given combination of the two control units in a control arrangement, the toner concentration and the fill level in the mixing unit can be regulated to the desired values without a conflict arising between the toner concentration regulation and the fill level regulation (meaning that one regulation prevents the other regulation).

The control arrangement is even further improved if the toner concentration regulation is allowed priority over the fill level regulation. For this an auxiliary arrangement can be provided that develops a standard quality between real value and desired value of the toner concentration from the toner concentration difference with this standard quality the desired fill level value is linked with a derived desired fill level value that is supplied to the control units instead of the desired fill level value. The linking is such that the influence of the fill level regulation is kept small given a larger toner concentration difference, and the influence of the fill level regulation remains unaffected given a smaller toner concentration difference. Given values of the toner concentration difference between the two extreme values, the influence of the fill level regulation is adapted correspondingly.

The preferred embodiment is explained in detail using the exemplary embodiment shown in the drawing Figures.

FIG. 1 shows components of an electrographic printing apparatus DS. The design and function of the printing apparatus DS are known and can be learned from WO 2005/013013 A2 or DE 10 2005 055 156 B3 (US 2006/0150836 A1), for example, the content of which is incorporated into this disclosure. Arranged along a rotating charge image carrier (a photoconductor drum in FIG. 1) are a regeneration exposure, a charging station, an exposure head, a developer station, a transfer unit to transfer-print the developed charge images onto a printing substrate, and an element to clean the photoconductor drum. Of these components, only the photoconductor drum 1, the developer station 2, the transfer unit 3, and the printing substrate 4 are shown in FIG. 1. The remaining components can be learned from DE 10 2005 055 156 B3 (US 2006/0150836 A1).

As an example, the developer station 2 has a developer roller 22 and optionally a cleaning device 23. The developer roller 22 can be arranged in contact with the charge image carrier 1. Charge images arranged on the charge image carrier 1 are developed into toner images with the developer roller 22. A developer fluid made up of at least a carrier fluid and electrically charged toner is used for this. The developer fluid can be supplied to the developer roller 22, for example via an inking roller 21 that applies developer fluid to the developer roller 22, wherein the inking roller 21 receives the developer fluid from a mixing unit 24 that is connected with reservoirs 25, 26 to supply toner concentrate and carrier fluid. The cleaning device 23 can be a cleaning roller that supplies the developer fluid cleaned off of the developer roller 22 to the mixing unit 24. The transfer unit 3 has a transfer roller 31 and a counter-pressure roller 32 in a known manner.

For a high-quality printing, the toner concentration and the fill level in the mixing unit 24 should be kept at predetermined desired values in the print operation. According to FIG. 2, for this the toner concentration and the fill level in the mixing unit 24 can be measured and the measurement values are used in a control arrangement RA with two control units RE1, RE2 in order to maintain the desired values of toner concentration and fill level in the mixing unit 24. For this the control arrangement RA is operated continuously and the toner concentration and the fill level are periodically measured via analog sensors and then are readjusted by the two control units RE1, RE2 (one for the toner concentration and one for the fill level). The tasks of the control units RE1, RE2 are to generate control signals for control elements (for example pumps) via which the feed (for example of toner concentrate and carrier fluid) into the mixing unit is regulated so that there is no danger that the two control units RE1, RE2 used for this simultaneously calculate opposing control signals for the toner concentration and the fill level (for example one control signal in order to increase the toner concentration in the mixing unit 24 and one control signal in order to reduce the fill level in the mixing unit 24). For example, the one control unit RE1 for the toner concentration may want to increase the toner concentration by supplying toner concentrate; at the same time, the fill level could already be over its desired value, such that the second control unit RE2 would like to prevent the supply of toner concentrate.

Figure 2:
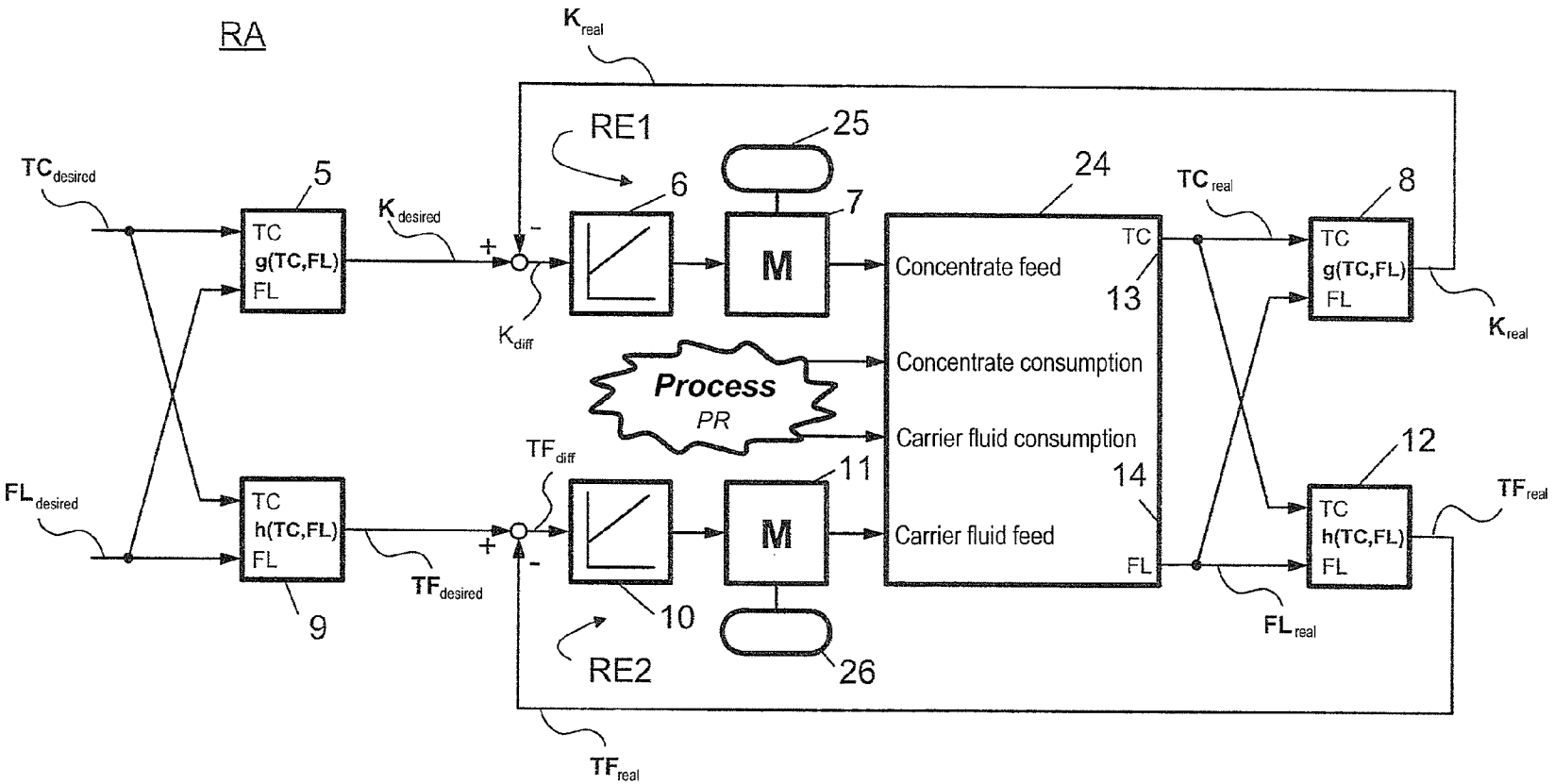
FIG. 2 is an embodiment of the control arrangement according to the preferred embodiment.

FIG. 2 shows a control arrangement RA with which the feed of toner concentration from a reservoir 25 and carrier fluid from a reservoir 26 into the mixing unit 24 is regulated. The control arrangement RA has the control unit RE1 and the control unit RE2, wherein the control unit RE1 provides a computer 5, a controller 6, a control element 7 and a computer 8, and the control unit RE2 provides a computer 9, a controller 10, a control element 11 and a computer 12. The toner concentration TC in the mixing unit 24 is then regulated with the control unit RE1 (called the TC regulation); in contrast to this, the fill level FL is regulated in the mixing unit 24 with the control unit RE2 (called the FL regulation).

The reference characters of FIG. 1 are used for the mixing unit 24 and the reservoirs 25, 26 in FIG. 2. A predetermined desired toner concentration value $TC_{desired}$ and a predetermined desired fill level value $FL_{desired}$ should be set and maintained in the mixing unit 24 in the printing operation. For this purpose the control arrangement RA has the first control unit RE1 for the toner concentrate and the second control unit RE2 for the carrier fluid. The first control unit RE1 has the first controller 6 that regulates the first control element 7 for the feed of toner concentrate from the reservoir 25 into the mixing unit 24. The second control unit RE2 correspondingly has the second controller 10 that regulates the second control element 11 for the feed of carrier fluid from the reservoir 26 into the mixing unit 24. The control elements 7, 11 can be pumps or valves.

The desired value of the toner concentration $TC_{desired}$ and the desired value of the fill level $FL_{desired}$ are not directly supplied to the controllers 6 and 10; rather, these are converted by a first transformation function g(TC, FL) (Formula (1)) into a desired value for the toner concentrate $K_{desired}$ that is supplied to the first controller 6 and by a second transformation function h(TC, FL) (Formula (2)) into a desired value for the carrier fluid $TF_{desired}$ that is supplied to the second controller 10. The real values in the mixing unit 24 for the toner concentration $TC_{real}$ and for the fill level $FL_{real}$ are likewise converted via the transformation function g(TC, FL) into a real value for the toner concentrate $K_{real}$ which is supplied to the first controller 6 and via the second transformation function h(TC, FL) into a real value for the carrier fluid $TF_{real}$ that is supplied to the second controller 10.

For the calculation of the desired toner concentrate value $K_{desired}$, the first computer 5 is connected before the controller which—with the aid of the transformation function g(TC, FL)—calculates the desired value $K_{desired}$ for the toner concentrate from the desired values $TC_{desired}$ for the toner concentration and $FL_{desired}$ for the fill level and applies this desired value $K_{desired}$ to the first controller 6. The second computer 9 is provided for the calculation of the desired carrier fluid value $TF_{desired}$, the second computer calculating the desired value $TF_{desired}$ for the carrier fluid from the desired values for the toner concentration $TC_{desired}$ and the fill level $FL_{desired}$ according to the function h(TC, FL) and supplies this desired value $TF_{desired}$ to the second controller 10.

The real value $TC_{real}$ for the toner concentration in the mixing unit 24 is measured by a first sensor 13; the real value $FL_{real}$ of the fill level FL in the mixing unit 24 is measured by a second sensor 14. The sensors 13, 14 can be known sensors operating analogously that periodically determine the measurement values.

The real value for the toner concentrate proportion $K_{real}$ is calculated by the third computer 8 from the real toner concentration value $TC_{real}$ and the real fill level value $FL_{real}$ via the transformation function g(TC, FL), which real value for the toner concentrate $K_{real}$ is then supplied to the input of the first controller 6. The real fill level value $FL_{real}$ and the real toner concentration value $TC_{real}$ are correspondingly transformed by the fourth computer 12 via the transformation function h(TC, FL) into a real carrier fluid value $TF_{real}$ that is then supplied to the second controller 10.

The toner concentration TC and the fill level FL are thus not directly used for regulation; rather, two auxiliary variables are calculated with the aid of the transformation functions g(TC, FL) and h(TC, FL) and these are supplied to the controllers 6 and 10. The proportion of the toner concentrate and of the carrier fluid in the mixing container 24 are thereby used as auxiliary variables. The conversion is implemented both for the desired values and for the real values of toner concentration and fill level. The two controllers 6, 10 are now activated with these auxiliary variables, the controllers 6, 10 independently activating their control elements 7, 11. Both auxiliary variables are decoupled via the transformation; and a mutual obstruction no longer occurs. Toner concentration and fill level are thus linked with one another with the transformation functions g(TC, FL) and h(TC, FL) so that the first controller 6 regulates the toner concentration in the mixing unit 24 without the fill level in the mixing unit 24 exceeding its desired value; and the second controller 10 likewise regulates the fill level in the mixing unit 24 such that the toner concentration maintains its desired value.

The transformation functions g(TC, FL) and h(TC, FL) result from the following Equations:

$$g(TC,FL)=FL*TC/TCC \quad (1)$$

$$h(TC,FL)=FL-g(TC,FL)=FL*(1-TC/TCC) \quad (2)$$

Figure 3:
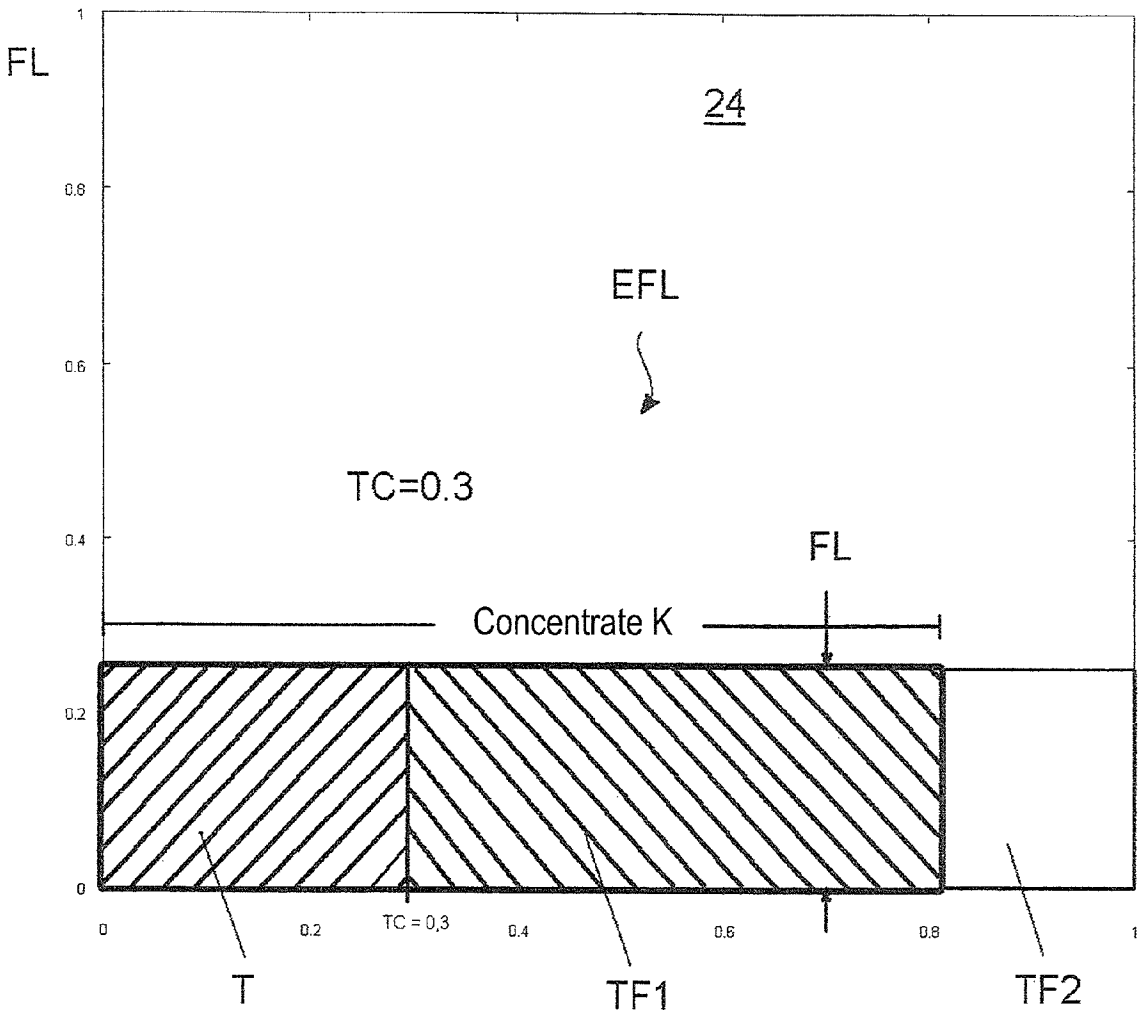
FIG. 3 is a mixing unit with developer fluid.

TC and TCC can be defined with the aid of FIG. 3. FIG. 3 shows as an example a mixing unit 24 that is partially filled with developer fluid EFL. The developer fluid EFL has a proportion of toner concentrate K and a proportion of carrier fluid TF2, wherein the toner concentrate K contains toner T and (for example) carrier fluid TF1. The fill level in the mixing unit 24 is designated with FL.

TC and TCC accordingly result as:

$$TC=T/(T+TF1+TF2) \quad (3)$$

The formula (3) thus indicates the toner concentration in the mixing unit 24.

$$TCC=T/(T+TF1) \quad (4)$$

The formula (4) indicates the toner concentration in the toner concentrate K.

The desired values of the toner concentration $TC_{desired}$ and of the fill level $FL_{desired}$ in the mixing unit 24 that are predetermined by the operator, and the real values of the toner concentration $TC_{real}$ and of the fill level $FL_{real}$ in the mixing unit that are measured by the sensors 13, 14, are transformed with the transformation functions (1) and (2).

The desired toner concentration value $K_{desired}$ is thus determined in the first computer 5 to which the desired toner concentration value $TC_{desired}$ and the desired fill level $FL_{desired}$ are supplied:

$$K_{desired}=FL_{desired}*TC_{desired}/TCC$$

The desired carrier fluid value $TF_{desired}$ is calculated with the second computer 9 via the transformation function h(TC, FL):

$$TF_{desired}=FL_{desired}*(1-TC_{desired}/TCC)$$

The real toner concentrate value $K_{real}$ is determined with the third computer 8 via the transformation function g(TC, FL) as $$K_{real}=FL_{real}*TC_{real}/TCC,$$

this real toner concentrate value $K_{real}$ being supplied to the first controller 6.

According to the transformation function h(TC, FL), the fourth computer 12 calculates the real carrier fluid value $TF_{real}$ from the real toner concentration value $TC_{real}$ and the real fill level value $FL_{real}$ into a value:

$$TF_{real}=*(1-TC_{real}/TCC)$$

that is supplied to the second regulator 10.

The difference $K_{diff}$ between real toner concentrate value $K_{real}$ and desired toner concentrate value $K_{desired}$ is then calculated with the first controller 6, and depending on the difference $K_{diff}$ the control element 7 is activated so that toner concentrate is supplied from the reservoir 25 to the mixing unit 24 as long as a difference $K_{diff}$ exists. The difference $TF_{diff}$ between real carrier fluid value $TF_{real}$ and desired carrier fluid value $TF_{desired}$ should be calculated correspondingly, and depending on the difference $TF_{diff}$ the control element 11 is activated so that carrier fluid is supplied from the reservoir 26 to the mixing unit 24 as long as a difference $TF_{diff}$ is present. The controllers 6, 10 can be realized as PI controllers of known design.

Not only the consumption of toner and carrier fluid (indicated by PR in FIG. 2) is taken into account with the regulation by the control arrangement RA; rather, influences on the developer fluid in the mixing unit are also considered that are caused by the feed of residual developer fluid (remaining on the developer roller 22 after the development of the charge images) into the mixing unit 24 after cleaning (by a cleaning roller 23, for example; FIG. 1).

According to FIG. 2 the two control variables (toner concentration TC and fill level FL) are treated identically in the control arrangement RA, meaning that the influence of deviations of the real value from the desired value on the control arrangement RA is equally large given both control variables (TC, FL). This procedure is acceptable given small deviations. Given larger deviations it can be advantageous to give preference to the regulation of the toner concentration TC over the regulation of the fill level FL. A prioritization of the regulation of the toner concentration TC can be introduced for this.

Figure 4:
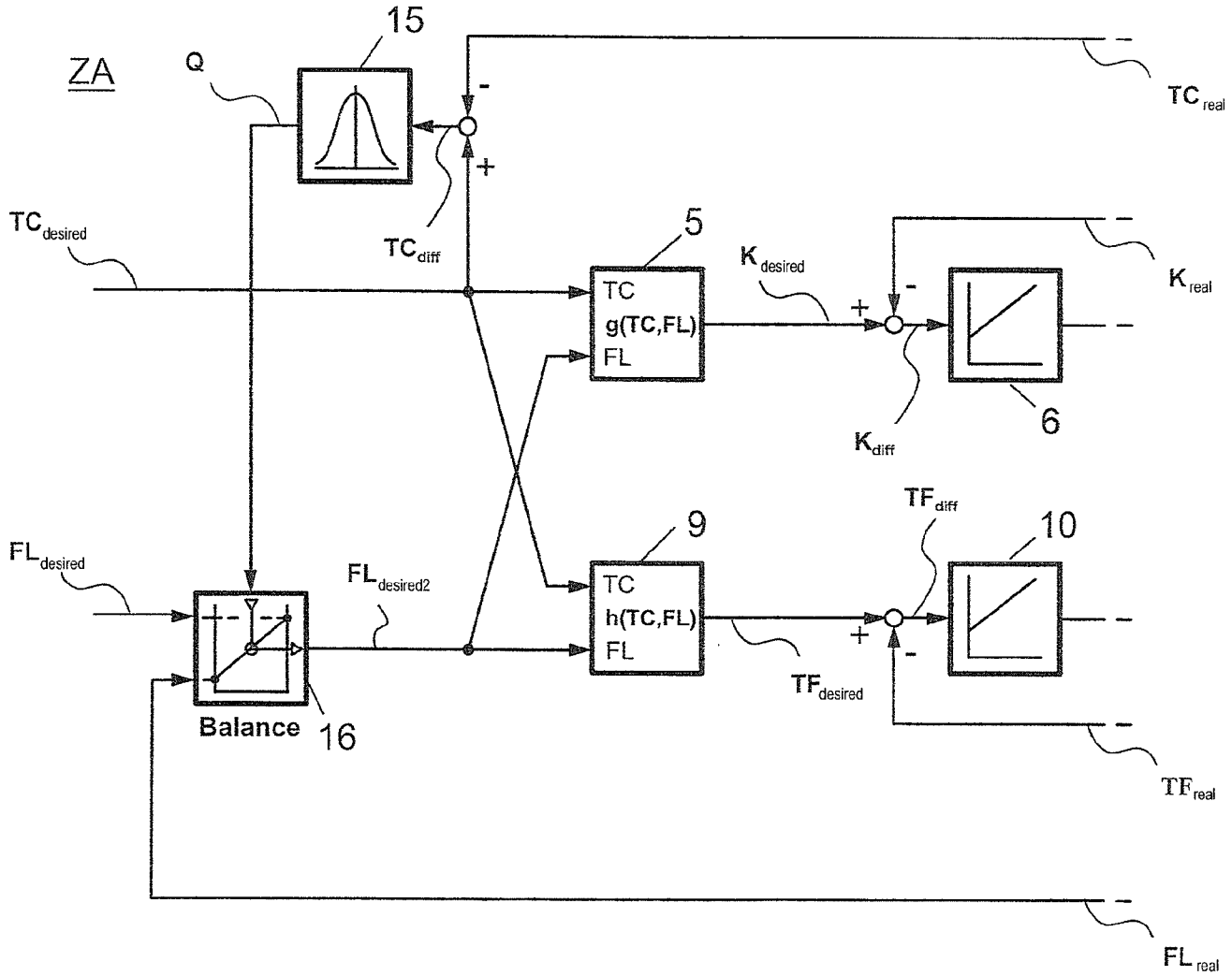
FIG. 4 is a development of the control arrangement according to the preferred embodiment in order to assign regulation of the toner concentration priority over the regulation of the fill level.

The extensions required for this in the control arrangement RA result from FIG. 4. An evaluation of the result of the toner concentration regulation initially takes place via comparison of the toner concentrations $TC_{real}$ with $TC_{desired}$. A standard quality Q is calculated from the difference $TC_{diff}$ between the toner concentrations $TC_{real}$ and $TC_{desired}$. The value of the standard quality Q should be "0" given large control deviations and "1" given small control deviations. According to table 1 it then applies that:

TABLE 1

| TC difference ($TC_{desired}$ − $TC_{real}$) | Standard quality Q |
|---|---|
| = 0 | = 1 |
| = ∞ | = 0 |
| lies between ∞ and 0 | always varies monotonically from 0 to 1 |

The standard quality Q is used for this in order to calculate a derived, variable desired fill level value_2 $FL_{desired2}$ that—depending on the standard quality Q—leads to the situation that the regulation of the fill level FL in the mixing unit 24 is more or less effective. For example, if the toner concentration difference $TC_{diff}$ is very small, the standard quality is close to Q=1 and the desired value of the fill level $FL_{desired}$ is used as a desired fill level value_2_$FL_{desired2}$ for the regulation of the fill level FL. In contrast to this, if the toner concentration difference $TC_{diff}$ is large, the standard quality is close to Q=0 and the desired fill level value_2 $FL_{desired2}$ is updated to the real value of the fill level $FL_{real}$.

FIG. 4 shows the auxiliary arrangement ZA with which the control arrangement RA according to FIG. 2 can be supplemented in order to achieve the desired prioritization of the toner concentration regulation. The auxiliary arrangement ZA has a computer 15 and a computer 16. The real toner concentration value $TC_{real}$ and the desired toner concentration value $TC_{desired}$ are supplied to the computer 15. The computer 15 calculates the standard quality Q (for example corresponding to Table 1) from the difference $TC_{diff}$ between $TC_{real}$ and $TC_{desired}$, which standard quality Q is supplied to the computer 16. Depending on the standard quality Q, the computer 16 converts the desired fill level $FL_{desired}$ into the desired fill level value_2 as $FL_{desired2}$ for the FL regulation. This desired fill level value_2 is then supplied to the computers 5, 9 as desired value $FL_{desired2}$.

One example of the determination of the standard quality Q results from the formula (5):

$$Q=10/(1+((TC_{desired}-TC_{real})/B)^2) \quad (5)$$

Figure 5:
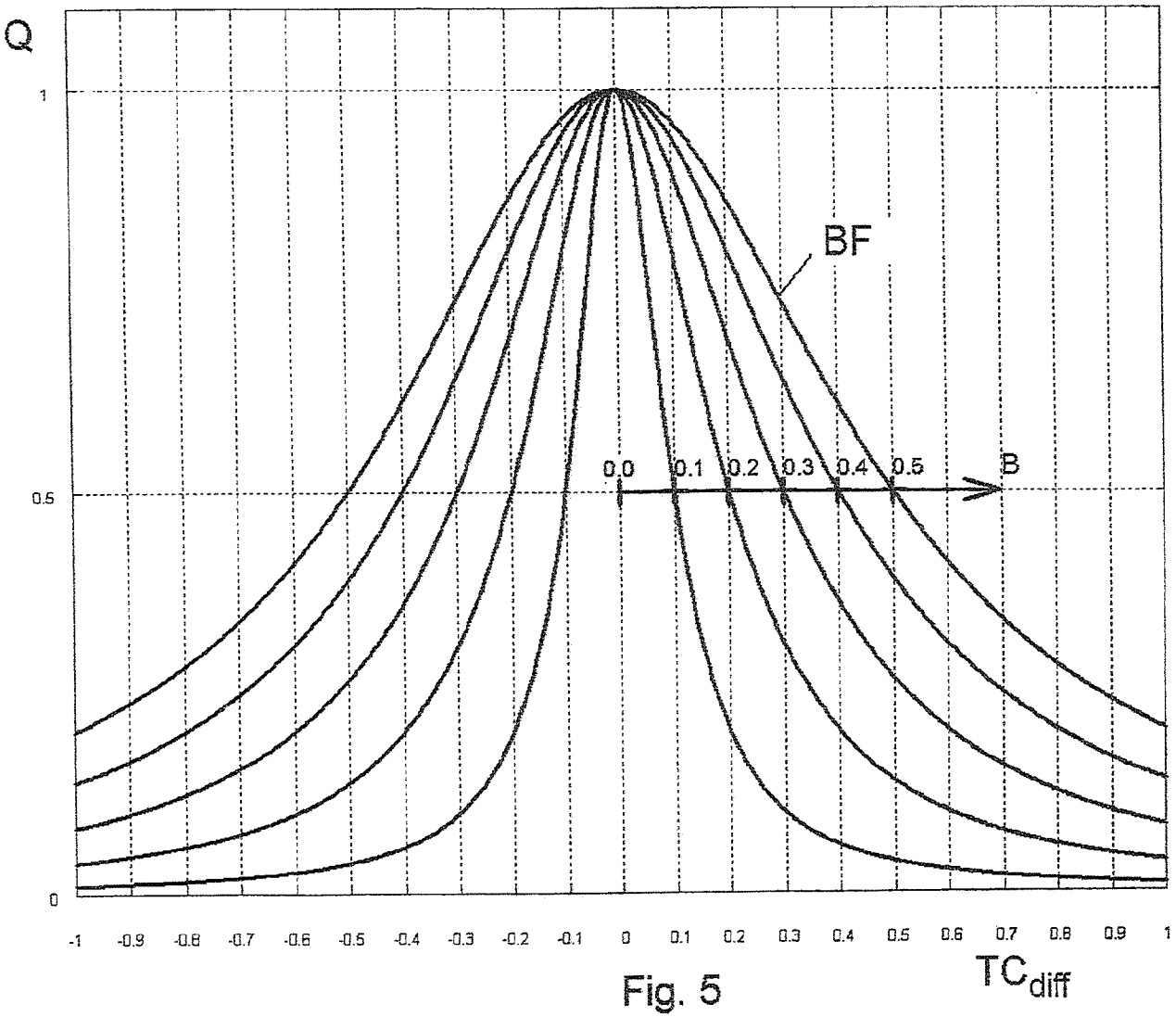
FIG. 5 are depictions of standard quality functions with which the influence of the fill level regulation can be varied in comparison to the toner concentration regulation.

Some curves BF calculated according to this standard quality function (5) to specify the standard quality Q are shown in FIG. 5. The curves are arranged symmetrical to the 0-axis. Positive and negative toner concentration differences $TC_{diff}=TC_{desired}-TC_{real}$ are thus treated identically. The standard qualities Q approach the value 0 in the positive or negative direction with increasing control deviations $TC_{diff}$. The bandwidth of the standard quality functions BF can be set via the selection of a parameter B. The standard quality Q has a value of 0.5 (median width) given toner concentration deviations $TC_{diff}$ that are equal in terms of magnitude to the bandwidth B. If the bandwidth B is selected to be very large, the calculated standard quality Q is close to 1 in a large range of the toner concentration deviations $TC_{diff}$. The prioritization of the TC regulation would thereby have only a small effect. The character of the regulation (TC regulation preferred or TC regulation and FL regulation having equal consideration) can thus be adjusted in wide ranges via the parameters B.

The standard quality function (5) is an example of the calculation of the standard quality Q. Other functions are possible; and it is only required that these can reproduce the values of Table 1.

Using the standard quality Q, the desired fill level value_2 $FL_{desired2}$ can be calculated as $$FL_{desired}2=Q*FL_{desired}+(1-Q)*FL_{real} \quad (6)$$

Depending on the standard quality Q, a value for the desired fill level value_2 $FL_{desired2}$ is determined that lies between the real fill level value $FL_{real}$ and the desired fill level value $FL_{desired}$. Given small values of the toner concentration difference $TC_{diff}$ (i.e. standard quality Q is close to 1), the desired fill level value $FL_{desired}$ is used for the FL regulation. As long as the toner concentration TC is not adjusted (standard quality Q is close to 0), the desired fill level value_2

$FL_{desired2}$ is closer to the current real fill level $FL_{real}$. Table 2 accordingly applies:

TABLE 2

| Standard quality Q | Desired FL value_2 |
|---|---|
| = 0 | = Real FL value |
| = 1 | = Desired FL value |
| lies between 0 and 1 | lies between real FL value and desired FL value |

Figure 6:
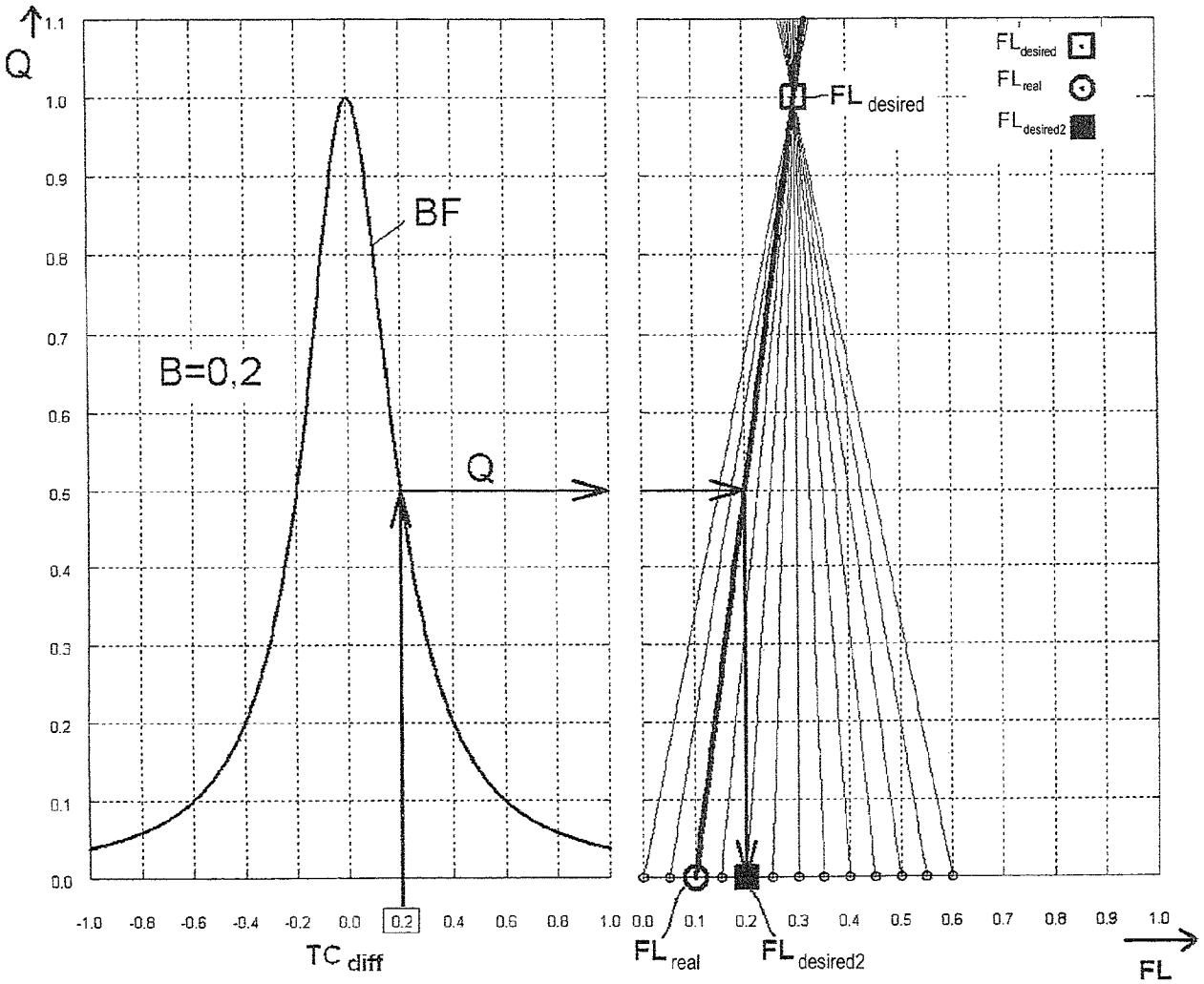
FIG. 6 is an example that indicates how an adapted desired value for the fill level regulation is determined from a standard quality function.

In principle the diagram of FIG. 6 shows the efficiency of the tracking of the desired fill level value_2_$FL_{desired2}$. The standard quality Q is calculated with the standard quality function (5) with a bandwidth B=0.2 (left side of the diagram, Q=0.5). Given the dimensioning of the tracking of the desired fill level value_2_$FL_{desired2}$, in the example a constant desired fill level value ($FL_{desired}$) of 0.3 and a current real fill level value of 0.1 ($FL_{real}$) are assumed (right side of the diagram; the diagram shows curves for different $FL_{real}$ values for $FL_{desired}$=0.3); both values are plotted in FIG. 6. The connecting line between $FL_{desired}$ and $FL_{real}$ in FIG. 6 comprises the region of the tracking of the desired fill level value_2_$FL_{desired2}$. The example assumes a TC difference of +0.2 (left side of the diagram). The standard quality Q therefore amounts to 0.5 and the tracked desired fill level value_2 ($FL_{desired2}$) results as 0.2 (right side of the diagram).

Figure 7:
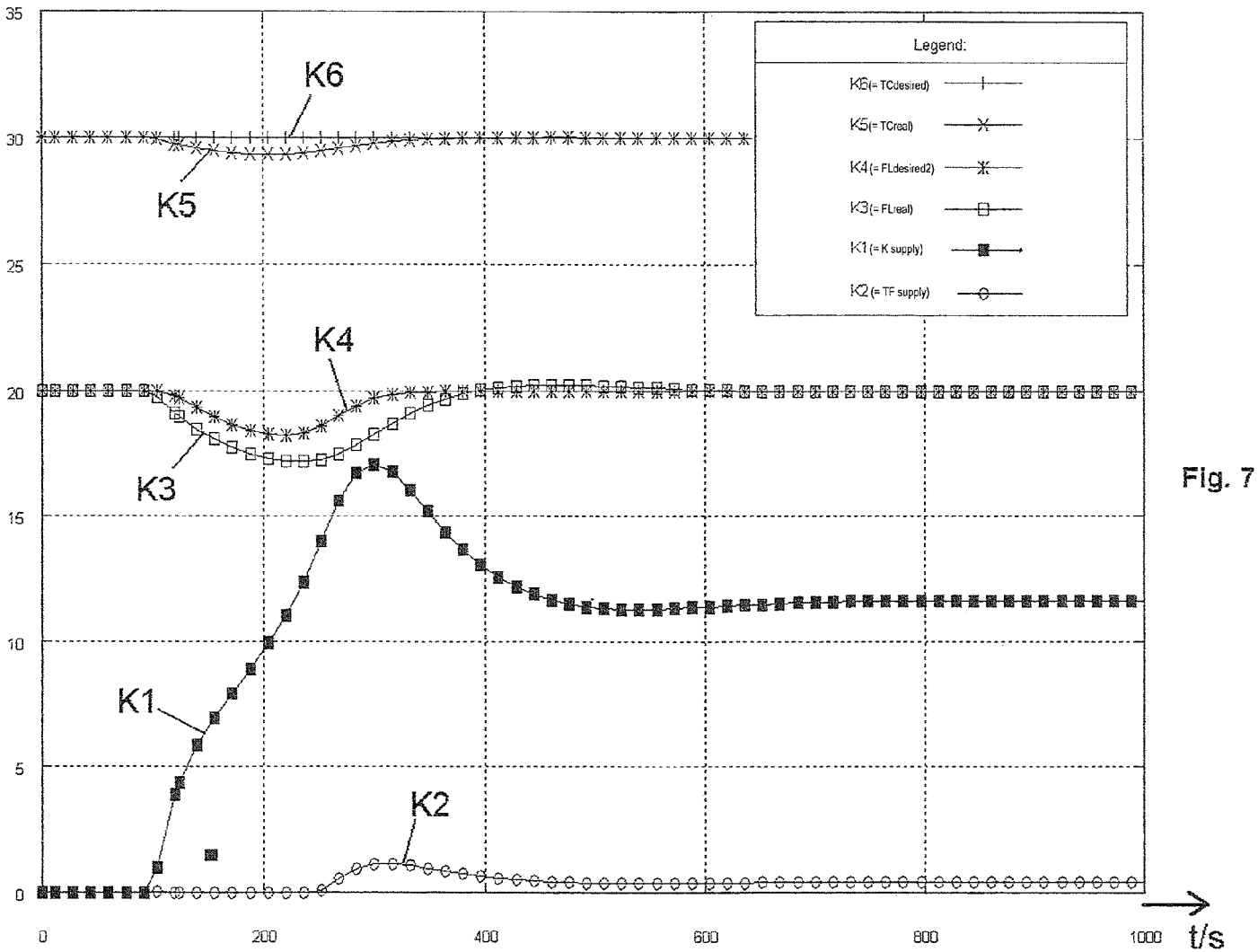
FIG. 7 is a diagram from which the mode of operation of the control arrangement is apparent.

FIG. 7 shows the time curve of a control arrangement RA simulated with the parameters of FIG. 6. Thereby shown are:

Curve K1: the feed of toner concentrate into the mixing unit 24;

Curve K2: the feed of carrier fluid into the mixing unit 24;

Curve K3: the real fill level value $FL_{real}$;

Curve K4: the desired fill level value_2 $FL_{desired2}$;

Curve K5: the real toner concentration value $TC_{real}$;

Curve K6: the desired toner concentration value $TC_{desired}$.

The toner fluid and carrier fluid consumption begins after a time period of 100 seconds in the printing operation, for example. It is apparent that the change of the toner concentration TC is in the mixing unit 24 is corrected more quickly via the prioritization than the change of the fill level FL. The desired value of the fill level $FL_{desired2}$ is tracked during the phase in which the toner concentration TC has not yet been adjusted. As soon as the toner concentration TC has been updated, the real value of the fill level FL has again reached the desired value $FL_{desired}$, for example a provided constant value of 20% of the content of the mixing unit 24.

Instead of prioritizing the toner concentration TC in the mixing unit 24, the fill level FL in the mixing unit 24 can also be given priority over the regulation of the toner concentration TC. For this it is only necessary that the arrangement according to FIG. 4 is changed accordingly. A standard quality must be formed depending on the difference between $FL_{desired}$ and $FL_{real}$; the standard quality is determined using the formula (5) and a desired TC value_2 is calculated with the aid of the formula (6), the desired TC value_2 being supplied to the computer 5, 9 (FIG. 2). The remaining components of FIG. 2 do not change.

The control arrangement according to the preferred embodiment therefore has the following advantages:

In the steady state the continuous regulation has a small residual error in comparison to conventional two-point regulations.

The multivariable regulation according to the preferred embodiment simultaneously regulates two variables. In running operation no special states must be taken into account, as would be the case in individual regulations.

The model forming the basis of the decoupling is calculated exactly. The model is valid in the entire value range.

The control variables calculated via the transformation are independent of one another. Each controller precisely regulates the variable for which there is a control element.

Due to the measures to prioritize the toner concentration over the fill level it is possible to first correct the toner concentration and to subsequently also correct the fill level as soon as the toner concentration is located in an established band. The prioritization automatically results during the continuous calculation of the control variables without a controller having to be stopped or without a controller having to be reconfigured.

The bandwidth outside of which the regulation of toner concentration has priority can be adjusted via a parameter. The behavior of the regulation can be adapted in wide ranges to the desired priority via the selection of this parameter.

The fill level regulation can also be given preference over the regulation of the toner concentration by swapping the two control variables.

The preferred embodiment has been described in connection with the regulation of the toner concentration and the fill level in a mixing container of a developer station of an electrophotographic printing apparatus. However, the preferred embodiment is not limited to this. It can be used anywhere two components are to be mixed together into a mixture product and mixture product is to be continuously removed from the mixture unit and consumed during operation. The proportions of the components in the mixing unit change due to the continuous removal of mixture product from the mixture unit and resupply of portions of components into the mixture unit. However, both proportions should be held constant to the predetermined desired values via regulation. This can take place by supplying the components. The supplied portions can thereby mutually influence one another. The desired values of the components in the mixing unit can then be corrected without mutual coupling via the use of the control arrangement RA according to the preferred embodiment.

Although a preferred exemplary embodiment is shown and described in detail in the drawings and in the preceding specification, it should be viewed as purely exemplary and not as limiting the invention. It is noted that only a preferred exemplary embodiment is shown and described, and all variations and modifications that presently or in the future lie within the protective scope of the invention should be protected.

I claim as my invention:

1. A system for continuous and simultaneous regulation of real values of toner concentration and fill level in a mixing unit to predetermined desired values in a developer station of an electrographic printing apparatus, said mixing unit having at least toner and carrier fluid, comprising:

a first reservoir for a toner concentrate having at least said toner and said carrier fluid, said first reservoir being connected via a first control element with a mixing unit;

a second reservoir for said carrier fluid, said second reservoir being connected via a second control element with the mixing unit;

a first control unit with a first regulator that regulates the first control element such that said real value of said toner concentration in the mixing unit is adjusted by supplying said toner concentrate from the first reservoir, the first regulator regulating the first control element depending on a desired concentrate value determined from the predetermined desired values of the toner concentration and fill level and depending on a real concentrate value determined from the real values of the toner concentration and the fill level measured in the mixing unit; and a second control unit with a second regulator that regulates the second control element such that said real value of said fill level in the mixing unit is adjusted by supplying said carrier fluid from the second reservoir, the second regulator regulating the second control element depending on a desired carrier fluid value determined from the predetermined desired values of the toner concentration and the fill level and depending on a real carrier fluid value determined from the real values of the toner concentration and the fill level measured in the mixing unit.

2. The system according to claim 1, further comprising:

the first control unit having a first computer and a second computer in addition to the first controller;

the first controller being connected via a first input with an output of the first computer at which the desired toner concentration value and the desired fill level value are present, said first controller calculating the desired toner concentrate value according to a first transformation function; and the first controller being connected via a second input with an output of the second computer at which the real toner concentration value and the real fill level value are present, said first controller calculating the real toner concentrate value according to the first transformation function, and wherein from a difference between the real toner concentrate value and the desired toner concentrate value, the first controller generates a control signal for the first control element for the feed of toner concentrate from the first reservoir to the mixing unit.

3. The system according to claim 2 wherein:

the second control unit has a third computer and a fourth computer;

the second controller is connected via its first input with an output of the third computer at which the desired toner concentration value and the desired fill level value are present, and said second controller calculating the desired carrier fluid value according to a second transformation function;

the second controller is connected via a second input with an output of the fourth computer at which the real toner concentration value and the real fill level value are present, and said second controller calculating the real carrier fluid value according to the second transformation function; and from a difference between real carrier fluid value and desired carrier fluid value, the second controller generating a control signal for the second control element for feed of carrier fluid from the second reservoir to the mixing unit.

4. The system according to claim 3 wherein:

the second transformation function reads:

$$h(TC,FL)=FL*(1-TC/TCC);$$

with regard to the mixing unit it applies that $$TC=T/(T+TF1+TF2) \text{ and } TCC=T/(T+TF1);$$

wherein T is the toner proportion in the toner concentrate;

TF1 is the carrier fluid proportion in the toner concentrate; and

TF2 is the carrier fluid proportion outside of the toner concentrate.

5. The system according to claim 3 wherein:

an auxiliary arrangement to prioritize the toner concentration regulation is provided with a fifth computer and a sixth computer;

the fifth computer calculates a value for a standard quality from a difference between the desired toner concentration value and the real toner concentration value; said value having a standard quality of 1 given said difference being 0, having a standard quality of 0 given said difference of ∞, and having a standard quality between 0 and 1 given said difference being between 0 and ∞;

with aid of the desired fill level value the sixth computer outputting a desired fill level value at an output depending on the standard quality, said desired fill level value corresponding to the real fill level value given the standard quality of 0, corresponds to the desired fill level value given the standard quality of 1, and corresponds to a desired fill level value between the real fill level value and the desired fill level value given values of the standard quality between 0 and 1; and an output of the sixth computer being connected with respective inputs for the desired fill level value of the first computer and the third computer.

6. The system according to claim 5 wherein the sixth computer calculates the desired fill level value according to a function $$FL_{desired2}=Q*FL_{desired}+(1-Q)*FL_{real}.$$

7. The system according to claim 2 wherein the first transformation function reads:

$$g(TC,FL)=FL*TC/TCC,$$

wherein with regard to the mixing unit it applies that:

$$TC=T/(T+TF1+TF2) \text{ and } TCC=T/(T+TF1),$$

wherein T is the toner proportion in the toner concentrate,

TF1 is the carrier fluid proportion in the toner concentrate, and

TF2 is the carrier fluid proportion outside of the toner concentrate.

8. The system according to claim 1 wherein an auxiliary arrangement is provided to prioritize a fill level regulation.

9. The system according to claim 5, wherein the fifth computer calculates the standard quality according to an equation $$Q=1.0/(1+((TC_{desired}-TC_{real})/B)^2),$$

wherein B is a freely selectable value between 0<B<1.

10. A method for continuous and simultaneous regulation of real values of toner concentration and fill level in a mixing unit to predetermined desired values in a developer station of an electrographic printing apparatus, said mixing unit having at least toner and carrier fluid, comprising the steps of:

adjusting the real value of the toner concentration in the mixing unit with a first control unit by supplying toner concentrate from a first reservoir;

determining a desired toner concentrate value from the predetermined desired values of the toner concentration and the fill level;

also determining a real concentrate value from the real values of the toner concentration and the fill level measured in the mixing unit;

regulating with the first control unit a feed of toner concentrate into the mixing container depending on a difference between said real toner concentrate value and the desired toner concentrate value;

also adjusting the real value of the fill level in the mixing unit with a second control unit by supplying carrier fluid from a second reservoir;

determining a desired carrier fluid value from the predetermined desired values of the toner concentration and the fill level;

also determining a real carrier fluid value from the real values of the toner concentration and the fill level measured in the mixing unit; and regulating with the second control unit a feed of carrier fluid into the mixing unit depending on a difference between said real carrier fluid value and the desired carrier fluid value.

* * * * *